US008602945B1

(12) United States Patent
Haubrich

(10) Patent No.: US 8,602,945 B1
(45) Date of Patent: Dec. 10, 2013

(54) WEIGHTLIFTING LASER LIGHT GUIDANCE TOOL

(76) Inventor: Mark Gene Haubrich, Union, WA (US)

( * ) Notice: Subject to any disclaimer, the term of this patent is extended or adjusted under 35 U.S.C. 154(b) by 493 days.

(21) Appl. No.: 13/069,302

(22) Filed: Mar. 22, 2011

Related U.S. Application Data

(60) Provisional application No. 61/282,715, filed on Mar. 22, 2010.

(51) Int. Cl.
*A63B 24/00* (2006.01)

(52) U.S. Cl.
USPC ..... 482/8; 482/1; 482/9; 482/92; 482/901

(58) Field of Classification Search
USPC ..... 482/1–9, 92, 900–902; 434/247, 250; 473/2
See application file for complete search history.

(56) References Cited

U.S. PATENT DOCUMENTS 4,688,796 A 8/1987 Wright
6,796,910 B1 9/2004 Foster
7,484,304 B2 2/2009 Campagna et al.
7,666,118 B1 * 2/2010 Anthony ..... 482/8
7,878,917 B2 * 2/2011 Johnson et al. ..... 473/220
2008/0034931 A1 2/2008 Nash
2009/0143156 A1 * 6/2009 Schulze ..... 473/46

* cited by examiner

*Primary Examiner* — Glenn Richman
(74) *Attorney, Agent, or Firm* — Sarah J. Rhoades

(57) ABSTRACT

The laser light weightlifting training appliance and guidance system will apply visible horizontal and vertical line or lines to a wall or chart during weight training exercises. A laser light housing holds the light source and attaches it to a weight or weightlifting bar. The housing is preferably provided with three laser light conveyance windows which may be used by the lifter or his coaches to receive immediate feedback as to the quality of his weight training technique and work out. The laser light housing is affixed to the weight training apparatus in any number of known manners. A built-in bubble-type level ensures the level mounting of the appliance housing onto the weight system. The combination of the laser and a landing position of the manipulated laser's light line or cross-shape on a wall or a chart permits a lifter to guide, improve, or correct his weight training technique.

28 Claims, 5 Drawing Sheets

WEIGHTLIFTING LASER LIGHT GUIDANCE TOOL

CROSS-REFERENCE TO RELATED APPLICATIONS

This patent application claims priority under 35 U.S.C. §119(e) to U.S. Patent Application Ser. No. 61/282,715, entitled "Laser Light Training Grove (sic) Line Apparatus" which properly should have been titled "Laser Light Training Groove Line Apparatus", and with a filing date of Mar. 22, 2010, which application is now pending. The entire disclosure of that provisional patent application is hereby incorporated by reference.

BACKGROUND

1. Field of Invention

This invention relates to aids for weightlifting training, and more particularly to such a weightlifting training aid with a laser light guide.

2. Description of Related Art

Weightlifting is a critical component in any fitness routine. It is a popular sport on its own accord and it is a highly recommended exercise for improving performance in other sports. However, weightlifting is a difficult skill to perform correctly and requires a great deal of training and time to master. For the novice weightlifter or for the enthusiast, it is absolutely vital that training occur in a controlled environment and with proper form. It is commonly known that improper training techniques will result in acute or chronic injury. For example, poorly executed squats commonly result in knee pain or back injury. However, other than hiring a fitness professional, it is very difficult for lifters to ensure they are training properly. Previously, experienced lifters were left to follow their physical recall and memory to perform correct techniques.

Proper training ensures the safety of the lifter and those around him. With proper guidance, training can be maximized for greatest modification and strengthening of the muscles. Furthermore, proper training techniques will ensure optimization of valuable time spent in weightlifting training.

BRIEF SUMMARY OF THE INVENTION

The weightlifting laser light guidance tool appliance comprises a laser light or laser light module, a laser light housing, an attachment means, and guide charts with visuals to communicate with the landing position of an elongated cross-shape emitted by the laser light beam. The laser light housing preferably comprises an outer box with at least one transparent glass lens or open vent through which the laser light will pass, a solid wall which can be affixed to the back side of a bar clamp for attachment, a miniature bubble level, a battery compartment for a laser light batteries, an on/off switch for the laser, a means to be selectively employed and to interfere with a portion of the laser light signal and coordinate with aspects of the charts. The preferred use of the present invention will be provided with a coordinated method of training inclusive of training charts. Training charts are provided for each specific weight training movement (e.g., dead lift, bench press, squats) or as one collective reference. Using the disclosed methodology and using the laser light to trace and follow the groove lines in the charts, the weight trainer may avoid injury, ensure safety of himself and others, and maximize muscle strength desired modification.

The weightlifting laser light guidance tool can be used in all weight training, including free weights, dumbbells, Olympic and Junior Olympic bars, straight bar, bent bar, and any other form of weight training instruments. The lifter using the device will be able to control and level his movements and know that those controlled movements are correct for the desired outcome and injury avoidance. Zones of multi-angular training for particular muscle categories are incorporated into the charts and assist a lifter in seeking improvement in particular muscle areas for definition or rehabilitation.

Primary pin-up charts may be provided to allow a lifter to guide and direct his movement during exercise. Secondary chart guides are the visual and target mats for improvement in the multi-angular muscle zones. Other charts may specifically provide color variations to highlight preferred exercises or preferred modifications. Ideally, a change between white and a non-white color will react and enhance visibility of a colored laser light cross or line or lines. The present invention will simplify course alignment. With the charts and the incorporated contrasting sections of light and dark color, the lifter's eye may quickly and easily assess his success or divergence from the recommended lifting pattern.

This laser light training appliance, system, and method will greatly assist in variable training techniques as well as all forms of weight training. As used herein appliance refers to an attachment, appurtenance, apparatus or tool for joining with a weightlifting unit. Safety, guidance, and modification during weightlifting exercises are provided and enhanced with the use of the present invention.

The foregoing has outlined, in general, the physical aspects of the invention and is to serve as an aid to better understanding the more complete detailed description which is to follow. In reference to such, there is to be a clear understanding that the present invention is not limited to the method or detail of construction, fabrication, material, or application of use described and illustrated herein. Any other variation of fabrication, use, or application should be considered apparent as an alternative embodiment of the present invention.

BRIEF DESCRIPTION OF THE DRAWINGS

The following drawings when viewed in conjunction with the entirety of this disclosure further describe by illustration, the advantages and objects of the present invention. Each drawing is referenced by corresponding figure reference characters within the "DETAILED DESCRIPTION OF THE INVENTION" section to follow.

DETAILED DESCRIPTION OF THE INVENTION

Figure 1:
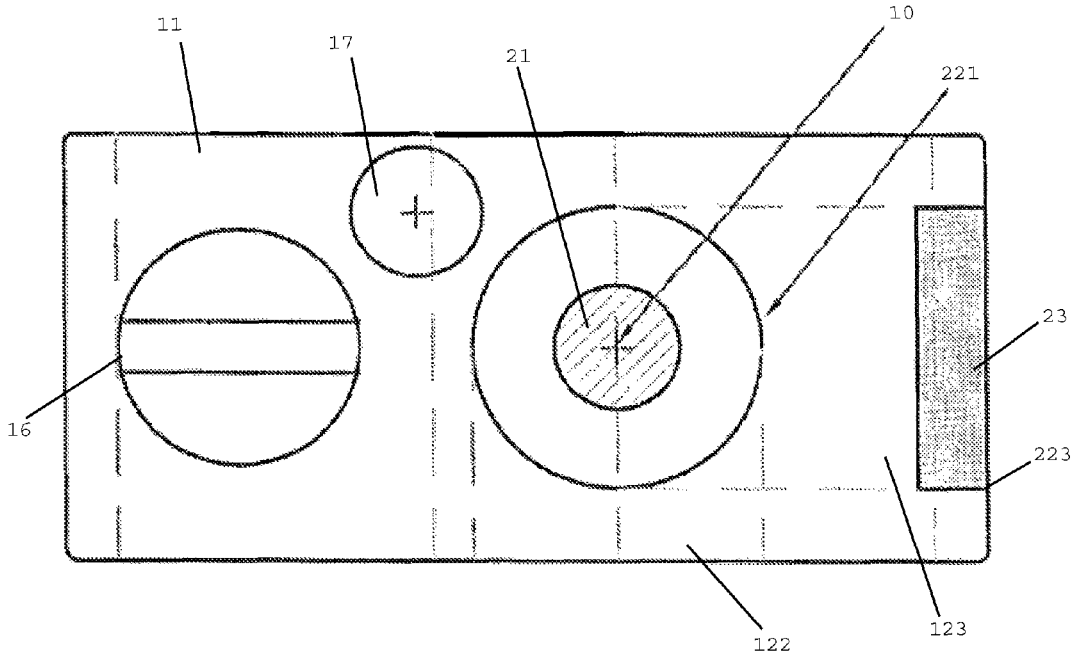
FIG. 1 is a top view of the laser light appliance according to the present invention.
Figure 2:
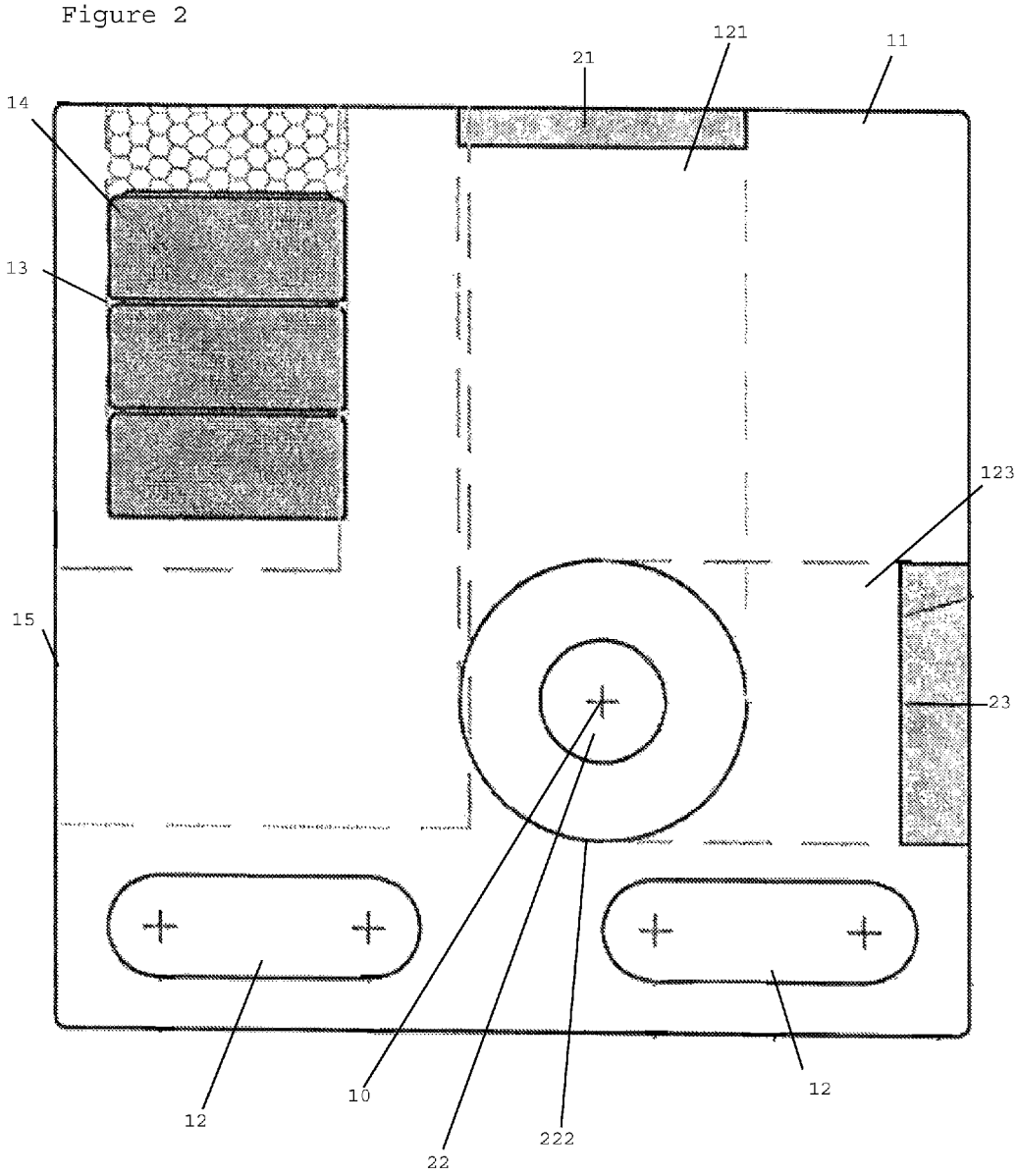
FIG. 2 is a front view of the laser light appliance according to the present invention.
Figure 3:
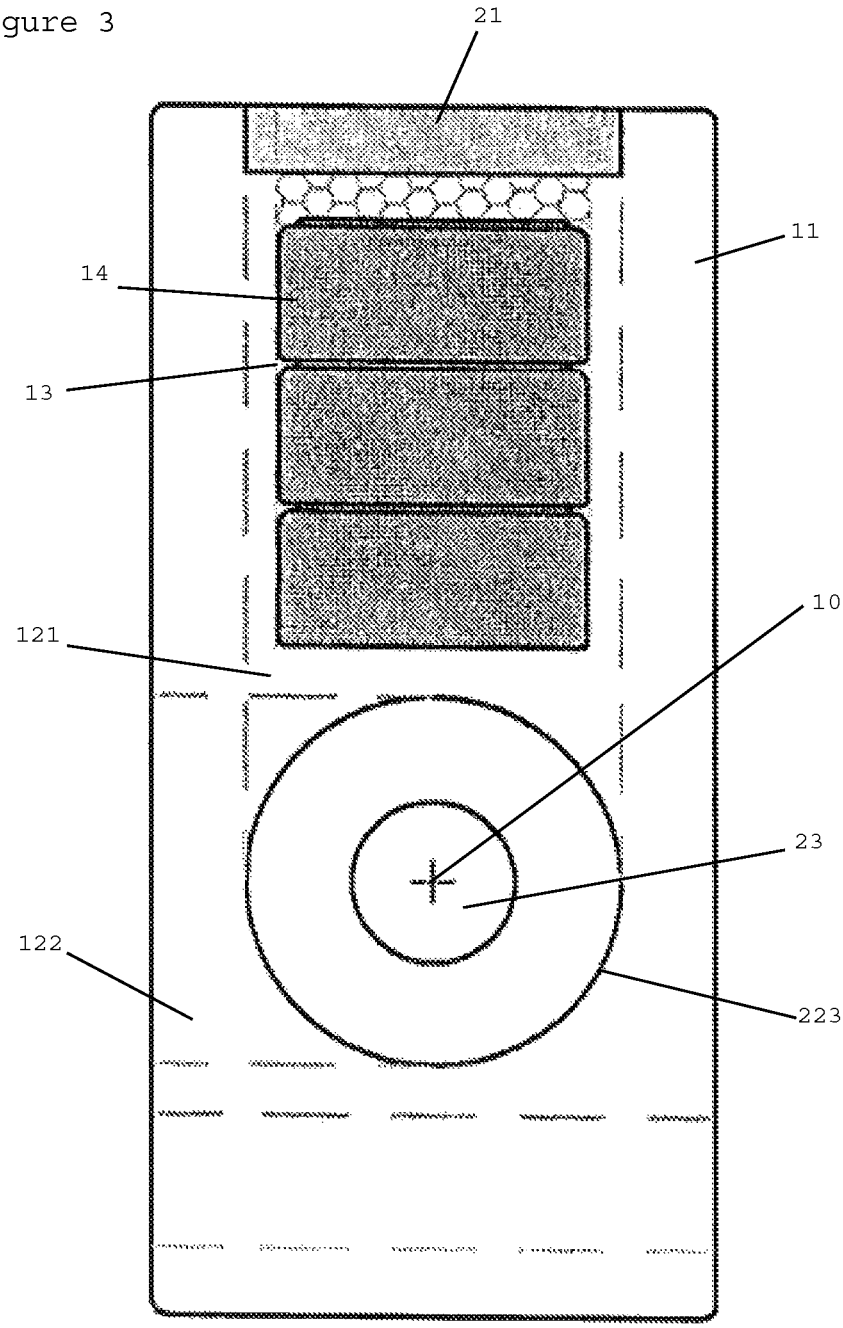
FIG. 3 is an end view of the laser light appliance according to the present invention.

The laser light weight training guidance appliance is discussed below and aspects are shown in the attached figures. As shown in FIGS. 1-3, the laser 10 is enclosed in a casing, or housing 11. The housing 11 of the tool will be constructed of pot metal, aluminum, plastic or other suitable material. The laser housing 11 includes amenities for attachment (12, 51) of the appliance to a weightlifting unit such as the disk bearing bar, battery enclosure 13, batteries 14, optionally, access to electronics in the beveled wall 15, switches (not shown) to control electronics. The housing 11 preferably will also provide a distance measuring device 17 such as a sonar insert assembly and related electronics (not shown). FIG. 1 shows a battery cover 16 for the battery enclosures 13. In one embodiment this will be a machined screw holder for three individual small, round, watch-type batteries. The battery enclosure should be shaped and formed to accommodate the appurtenant battery power selection. In the preferred embodiment, the battery enclosure is a vertical column shaft for three identically shaped watch batteries.

Referring to FIG. 2, the preferred embodiment presents three laser windows or vents 21, 22, and 23. These windows are apertures and are universal to each laser outlet location. In the drawings some windows are shown from the side as well as in straight-on view. The top laser window 21 would allow laser light to escape to the ceiling from the housing 11. The end laser window 23 (FIG. 3) would allow light to escape to the sides and the front laser window 22 (FIG. 2) would allow light to escape to the front of the free weight bar. Each laser light output has its own insert and channel, or tunnel. See FIGS. 1-3 channels numbered 121, 122, 123, shown in phantom. The laser is enclosed in the housing 11 at the base of these respective channels. The corresponding window flanges appear in FIGS. 1-3 at 221, 222, and 223, respectively. Notably, FIGS. 1-3 show the laser pattern design enhancer for the cross-shape pattern output. As used herein the cross-shape means two intersecting line fragments. The line fragments are approximately the same length and intersect at or near perpendicular.

The end view of the appliance demonstrated in FIG. 3 shows the laser 10, the laser window 22, the batteries 14, the battery enclosure 13 and the end of the laser channels as covered by a flange 223. The batteries and battery enclosure are also demonstrated in FIG. 2. The preferred power supply is several mid-sized, watch batteries but any similar, suitable power source will suffice. The views are partially transparent to reveal details which may not be visible during application.

The preferred light source for the present invention will be a standard carpenter mid-grade laser, red in color. Any low to moderate class (dependent on power and wavelength) laser will accomplish the invention objectives. In the preferred embodiment, the laser will already be formed, shaped, or manipulated to project a line or adjustable, cross-shape, a rectangular narrow beam, or comparable emission of light. The laser will require a power source such as a battery or several batteries which are small in size and hold a powerful charge. The housing includes a chamber for the onboard storage of batteries and will also provide a switch, button, or other means to control when the light should be activated.

Figure 5:
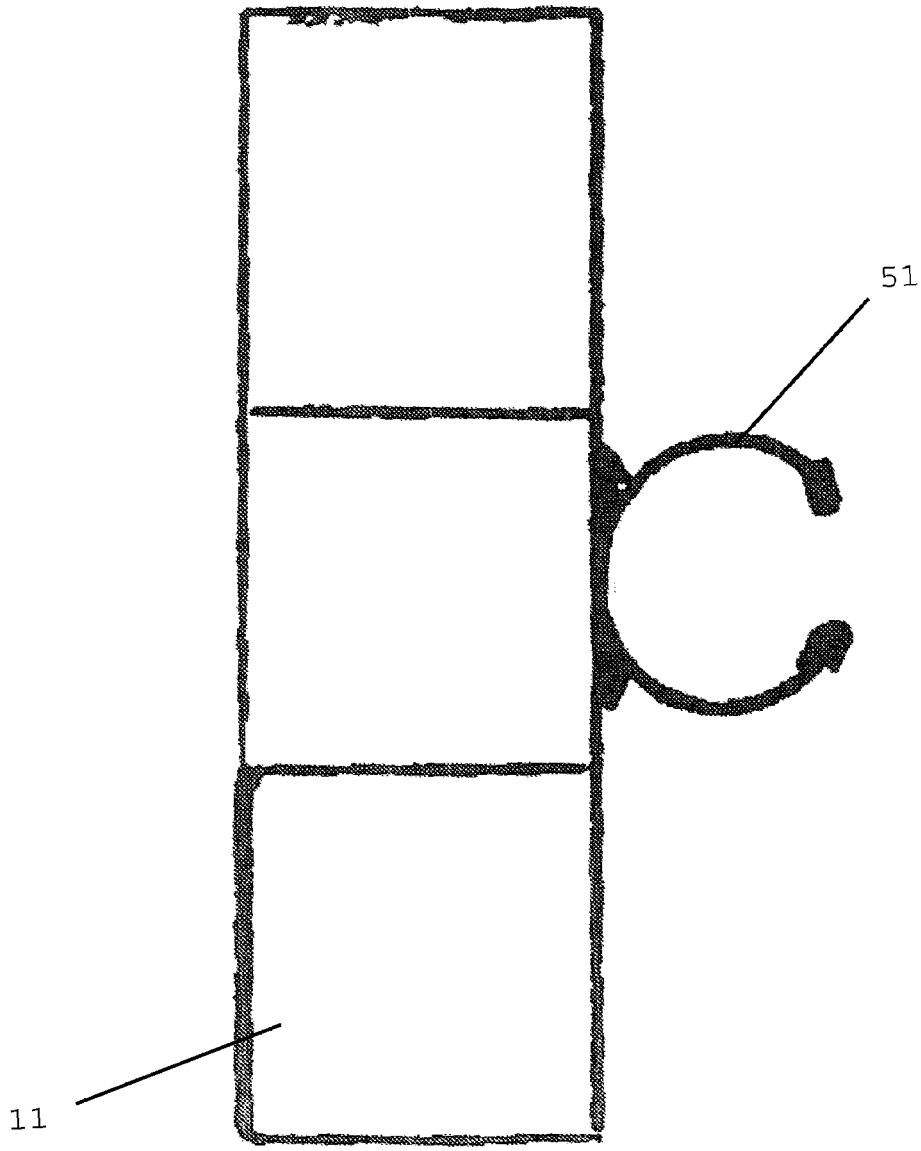
FIG. 5 is a side view of one embodiment of the tool demonstrating one example of a clamping mechanism to hold the laser housing to a bar or other weightlifting equipment.

The attachment of the appliance may be in any way known that will allow the laser housing to be applied to a weight training unit. Each type of weightlifting unit, weight bar, or dumbbell requires an attachment method specific to its diameter and operation. The preferred embodiment uses a clamp such as a C-clamp 51 or a bar clamp because many weightlifting bars are not ferromagnetic. See example clamp 51 in FIG. 5. If the appliance was being made to a ferromagnetic weightlifting unit such as dumbbells then it would be advantageous to incorporate magnets 12 into the base side of the laser housing. More often the use of straps would be desirable so one housing modification would include loops or slots through which hold-down straps could be threaded. Other attachment variations will be obvious in light of these examples and this disclosure and consistent with the objectives of the invention.

Incorporation of electronics into the housing or casing unit may be necessary. Line variance on charts may need a conversion hand-held guide with a system for optimal movement, rhythms, strokes, and measurements, as well as programming between all of the sports where the person may be interested in applying the lifting work that they have invested. Rehabilitation programs and casual lifters might have their own programming desires which can be incorporated into electronic and computer training interfaces. Preferred training systems and techniques are subject to interpretation and will need clinical study. For now, it is known that stability and small shifting off of a lift line is noticeably desired and this invention in its simplest form will assist with those goals. In embodiments with incorporated electronics, access panels 15 for controlling the electronics of the distance measuring or laser output aspects of the invention will be required. Access and control of electronics may occur on the face of the housing or behind an access panel (e.g., 15).

One embodiment of the present invention provides a distance measuring device 17. One known manner to measure distance which would be particularly useful in this invention would be sonar measuring techniques used for small scale measurements, such as those less than 25 feet. The sonar distance measuring tool gives the user a LCD reading of the distance from the nearest wall or ceiling. The distance tool can measure consistency in the strokes, meaning both distance and length of each stroke repetition. The lifter has the choice of measuring ascending and descending cheater strokes as well. Cheater strokes are the non-full range of motion repetition in a zone of reasonable stroke length. It can measure and turnout consistency in standard of the repetitions. This is not a required feature, and perhaps not all models of the appliance would have it, but it is useful to a lifter as some repetition strokes during a workout are designed to be shorter and some longer. All measurement outputs are on the scale of inches. A sonar measuring device will allow choice of isometric, isotonic or isokinetic movement and their conversions and translations for various sports. Isometric means working against non-moving, or stationary, weight. Isotonic means weight being added or subtracted by the spotter or by equipment. Isokinetic movement works against moving weights using hydraulic, electric or water-iris-resistance utilizing CNC computerized training records.

The interior of the laser housing in one embodiment will include a tin lid blocker or similar interference device that will convert the laser beam output to a single elongated line, a series of laser dots, or the default cross shape. Other known laser-shape cut-outs or irises may be used to manipulate the laser output. The lines, dots, or cross can be used to coordinate with particular pin-up charts, especially those targeting multi-angular training developments. In general, multi-angular training refers to doing repetitions within the same exercise set at minutely different angles along the path of the muscle being worked. As described in the bench press technique herein, this means working along the line of the cleavage. In the squat exercise technique, multi-angular or zone training refers to finding a zone where inversion hip balance (the leg equivalent of the cleavage line) can customize walk, gait, strength, or running strides. In rehabilitation, this is the key process that rebuilds the gluteus maximus and side sweep of the hip, where a standard stroke for repetitions allow for little improvement without a multi-angular program and the visual guidance of the present invention.

The preferred embodiment of the present invention will have a metal housing, about 3.5 inches long from end to end. The tool is attached to a weightlifting bar with a C-squeeze aluminum clamp with a ¾ inch to 1⅜ inch clamp bite. The clamp is soldered to the metal side of the laser housing having no laser windows. The laser light may be self contained or in a laser module which is rectangular in shape and a ¾ inch by 1 inch cube. At about 7 feet from the light source, the laser light lines of the cross should be approximately 3 feet in length but within a range of 2 to 4 feet will suit the purpose. The housing also incorporates a small transparent, mini-level with a bubble. This level is used to ensure the housing is attached to the lifting equipment in a position that begins level. The housing in the preferred embodiment carries the electronic power, controls, and switches to activate the laser. The laser power for the light line may be a Class 3A laser but may also be a lower class laser.

Charts used in the methodology of the present intention are comprised of visual cues or indicators such as a may be printed or presented on a pin-up grid. Any material may be used including paper, plastic system, or simply paint on a wall. The chart size in the preferred embodiment is approximately 4 feet tall, but size variations will be necessary where the chart is farther from the light source.

Visibility should be enhanced on the chart. Visibility enhancement tools will depend on the color and strength and perhaps distance of the light crossing lines interacting with the chart. Reflective visuals are desirable for lower class lasers or non-laser light sources. Other charts may specifically provide color variations to highlight preferred exercises or preferred modifications. Ideally, for a red colored laser light lines of the cross, a change between white color and a dark green or light green color will react and enhance visibility of the landing position of the light. This is because the green color tends to neutralize the color of the red while the white color will make it more apparent. The contrast allows quick computation and adjustment by the lifter. The present invention will simplify course alignment. Other charts may specifically provide color variations to highlight preferred exercises or preferred modifications. Scores and scoring may be incorporated into charts but are not a necessary part of the appliance use. Scores could be used as a type of motivational competition between lifters, with the better score being defined on the chart by a lifter being able to keep the laser closest to "perfect".

Figure 4:
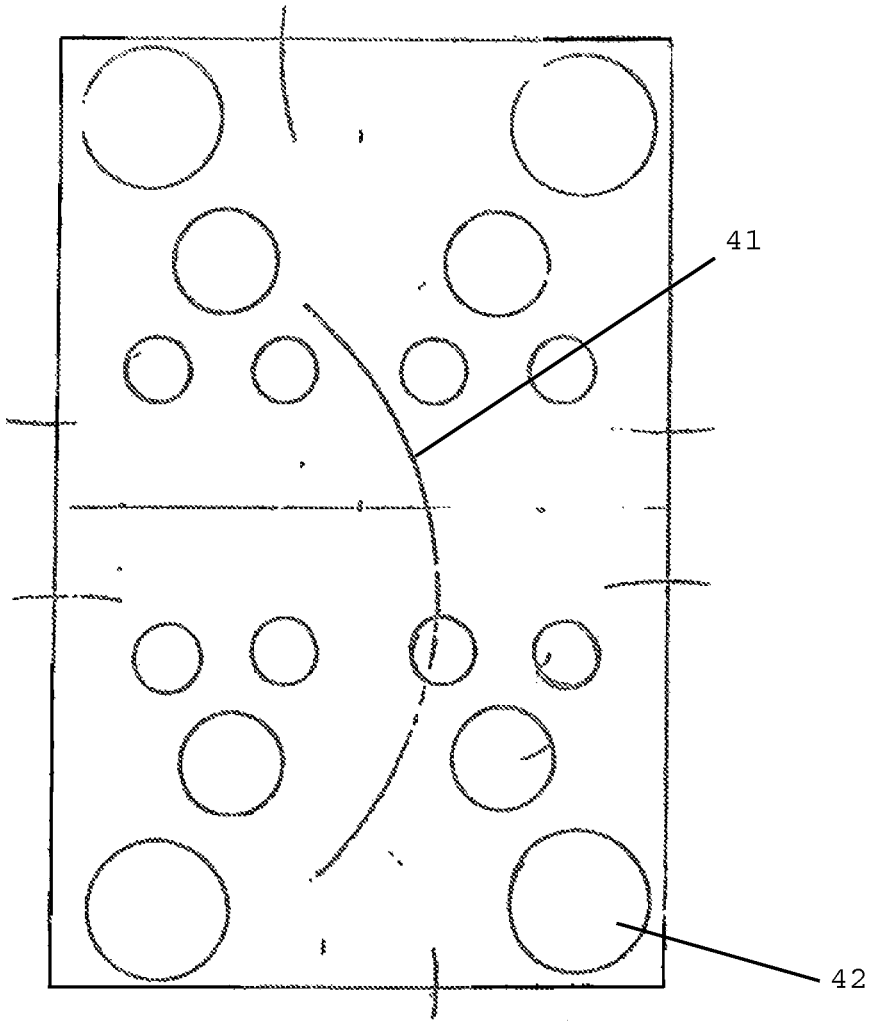
FIG. 4 is a schematic example of a training guidance chart which may be used in conjunction with the appliance.

The present invention serves a catalog of weightlifting training movements specifically including a bench press, deadlift, and squats. The device could be adapted to also serve a series of other weightlifting exercises (e.g., front squats, overhead press, rows, power clean, jerk, etc.). During a flat bench press exercise a lifter is on his back on a flat bench with his feet flat on the floor. The lifter raises a standard Olympic bar, with plate weights on each end, off of a rack. He lowers the bar to his chest, and pushes it back upward, then repeats the lowering and pushing motions for a chosen number of repetitions. The present invention aids in proper bench press form. On a flat bench press the spotter is near the head of the lifter. The 'spotter' is another person accompanying the lifter in case the lifter needs assistance replacing the weight to its holding stand. When viewed from the left side of the lifter and spotter, three projections are being made by the present invention at one time. The first is on the ceiling or on a chart on the ceiling. The preferred chart has lines that are horizontal with some lines thicker as they fan outward. The finer lines are toward the middle on the ceiling chart. One example of a preferred chart in its infancy stage is shown in FIG. 4 and has been and is called "Chart 2" herein. The chart can be on the wall nearest the lifter's feet and the wall at which the spotter is looking when he looks straight ahead. During preferred use, a duplicate of the chart can be to the left of the lifter on another side wall or vertical surface for additional reference by the spotter. Each chart will comprise a specific line pattern tailored to allow the user to follow a standard or non-standard lifting movement or stroke. A small amount of deviation during a lift may be safe and normal. Intentional deviation may be warranted to create a custom chest such as by aiming the laser in a primary stroke zone and then visually performing repetitions in front and in back of that primary line to work a wider range of muscle fibers along the cleavage line of the chest. However, the present invention, using lines 41 and circles 42 such as those shown in FIG. 4, which coordinate with the light shining on them, act as lifting guide tools to assist the lifter in avoiding dangerous exercise deviations. Chart 2 and its light green dots and patterns, neutralize the laser cross during the interference of instability during lifts.

The ceiling of the room where exercise is occurring needs to be 9-20 feet in height. If there is no vertical wall within about 9-20 feet of the training station then another surface such as a partition must be implemented as a landing surface for the lighted laser cross. The same holds true for the left side wall, if used. When the laser leveling device is either strapped or clamped to the weight bar, side wall usage will be limited depending on the type of weight training system used. Weight systems typically call for solid disk-shaped weight plates to be threaded onto the bar. Such a solid disk would obscure the travel path for the laser light beam. The only weight plates that can be used for side projection are those such as Cenco because there are 5 large oval holes in the plates through which the laser light beam can shine, hitting the side wall of the room and the charts, if used, mounted thereon.

Ideally for the bench press, all three lights help in spotting and coaching. During a bench press, the lifter may not be able to see the side wall projections, but his spot or coach may use the laser light output to assist the lifter. A lifter's assisting coach or spotter will be able to perceive, instruct, and help correct errors in form occurring during the lift. Correct form should result in the laser light output tracing or creating a "J" pattern on a side wall, likely the left wall, during the bench press. Undesirable bar roll can be seen in movement of the lines of the laser light cross or line projecting on the side wall. On the forward wall, the spotter will be able to perceive and assess the rhythm and rate of the lift as well as levelness of the push portion of the lift. The lifter can only see the one on the ceiling during this move. On the ceiling chart, movement of the bar is shown as a jittery and unstable pattern. The further the distance between the lifter and the ceiling, the more the movement will be exaggerated. During a bench press a regular line chart having parallel horizontal lines should be used by applying it to the ceiling where it can provide a reference guide for the lifter. Note, however, a chart is not absolutely necessary and the height of the ceiling is not critical to the functionality of the invention.

The lifter and spotter are able to continue to use this same appliance and format even if they change the incline or decline angle of the bench Changing the angle is part of a regular lifting routine.

A squat is the exercise where a lifter positions and balances a standard Olympic bar having weight plates on each end on the upper back at the base of the neck. The lifter then performs a squatting motion from straight legs to knees bent with upper leg parallel to the floor, or lower as desired. The lifter returns to standing straight for the conclusion of one repetition. This downward motion followed by the return to standing straight motion is repeated for the desired number of repetitions.

To implement the present invention for the squat exercise, the charts are positioned on the ceiling, in front of the lifter, and to the left of the lifter. At least one small mirror, the approximate size and shape of a yardstick, is propped against the wall directly in front of the lifter and at approximately a 45 degree angle. The mirror must have a support, such as a strong plastic backing about an inch thick, to keep it from bowing or breaking. The lifter can monitor the ceiling chart where the laser light cross is showing movement in the lift front to back and side to side. With the assistance of the small mirror, a small portion of the laser light cross will be shown on the ceiling as well. This is all that is necessary to monitor the proper technique. At the front wall or surface, the lifter is watching a vertical laser line to help him restrict twisting side to side motions in the lift which are dangerous to the lifter. A spotter or lifting partner will be able to watch, assess, and provide feedback about the laser light projected to the left of the lifter. Again, this side view will be most helpful in monitoring and ensuring that a correct amount of bar roll is occurring during the repetition.

A deadlift exercise consists of the lifter pulling a standard Olympic bar loaded with weight plates from the floor. The lifter begins in a bent position and completes the exercise by standing straight with head up, shoulders back, and back straight and the bar is touching the lifter's thighs. For this exercise, references or charts are to the left and in front of the lifter, preferably starting at the junction of the floor and wall. The lifter can see both laser light outputs during this exercise by using their peripheral vision. The lifter is looking for the completion of the lift to fall within a pre-marked height range which may be included in the references or charts on the walls. He can assess the rate, tempo, and levelness of his form and lifting style. In a deadlift, excess bar movement is dangerous. With the present invention, the lifter can minimize bar movement by using the light emission as a visual aid toward the practice of proper technique, thereby maximizing the exercise and reducing likelihood of injury. Here multi-angular customization does not apply.

These have been examples of fabrication and demonstrations of methodology for use according to the present invention. It is further intended that any other embodiments of the present invention which result from any changes in application or method of use or operation, method of manufacture, shape, size, or material which are not specified within the detailed written description or illustrations contained herein yet are considered apparent or obvious to one skilled in the art are within the scope of the present invention.

I claim:

1. An appliance to guide an individual in weightlifting, the appliance comprising:

a housing defining at least two apertures and holding a laser, the laser formed to project at least one light beam, the laser light beam emitted through at least two apertures, the housing having an attachment means whereby the housing may be attached to a weightlifting unit, the apertures formed and positioned so that one laser light beam projects a light beam onto at least one surface visible to the individual using the weightlifting unit.

2. The appliance of claim 1, wherein the laser light beam is projected on two surfaces.

3. The appliance of claim 1, wherein the housing defines three apertures.

4. The appliance of claim 3, wherein the laser light beam is projected on three surfaces.

5. The appliance of claim 1, wherein the apertures are formed and positioned so that the light beam projects two intersecting line fragments visible to the individual using the weightlifting unit.

6. The appliance of claim 5, wherein the housing is mounted on the weightlifting unit so that the intersecting line fragments visible to the individual are between 2 feet and 4 feet in length.

7. The appliance of claim 1, wherein the housing is mounted on the weightlifting unit so that the light beam projected creates an elongated, horizontal line visible to the individual.

8. The appliance of claim 1, wherein the housing is mounted on the weightlifting unit so that the light beam projected creates an elongated, vertical line visible to the individual.

9. The appliance of claim 1, wherein the surface visible to the individual using the weightlifting unit is a vertical surface.

10. The appliance of claim 1, wherein the surface visible to the individual using the weightlifting unit is a non-vertical surface.

11. The appliance of claim 10, wherein the surface visible to the individual using the weightlifting unit is a mirror.

12. The appliance of claim 1, wherein the surface in view of the individual using the weightlifting unit further comprises a chart.

13. The appliance of claim 12, wherein the chart further comprises contrasting visuals.

14. The appliance of claim 12, wherein the chart guides technique to at least one weightlifting exercise.

15. The appliance of claim 1, wherein the housing further provides a means to measure distance.

16. The appliance of claim 15, wherein the means to measure distance is a sonar measurement tool.

17. The appliance of claim 1, the housing further comprising a line-dot selector which may be employed to interrupt the laser light beam in a designated pattern.

18. The appliance of claim 1, the housing further comprising a leveling device.

19. An appliance to guide an individual in weightlifting, the appliance comprising:

a housing defining at least two apertures and holding a light source module, a light source in the light source module, the light source formed to project at least one cross-shaped light beam, the at least one cross-shaped light beam emitted through the at least two apertures, the housing having an attachment means whereby the housing may be attached to a weightlifting unit, the apertures formed and positioned so that one cross-shaped light beam projects onto a surface in view of the individual using the weightlifting unit.

20. The appliance of claim 19, wherein the housing defines three apertures.

21. A method to improve techniques used by an individual in weightlifting, the method comprising steps of:

attaching a laser light with a directed output to a weightlifting unit, shining the output on at least one surface, perceiving the movement of the laser light output on the surface, maintaining a steady and fluid weightlifting technique based on the perceived movement of the laser light output on the surface.

22. The method of claim 21, further comprising the step shining a laser light output on two surfaces.

23. The method of claim 21, further comprising the step of shining a laser light output on three surfaces.

24. The method of claim 21, further comprising the step of shining a laser light output on a non-vertical mirror.

25. The method of claim 21, further comprising the step of shining a laser light output onto a surface further comprising a chart.

26. The method of claim 25, further comprising the step of shining a laser light output onto a chart having contrasting visuals.

27. The method of claim 25, further comprising the step of following proper technique in weightlifting using a chart having guides.

28. The method of claim 21, further comprising the step of measuring consistency in a weightlifting stroke with a sonar measuring device.

* * * * *